US007533788B2

(12) United States Patent
Harvey et al.

(10) Patent No.: US 7,533,788 B2
(45) Date of Patent: May 19, 2009

(54) VALVE AND TAP INCORPORATING SAME

(75) Inventors: Neal Harvey, Pocklington (GB); Peter Viner, Wetherby (GB); Roseanne Gilhooly, Rathmines (IE); Daniel Donnelly, Stilorgan (IE)

(73) Assignee: Diageo Ireland, Dublin (IE)

( * ) Notice: Subject to any disclaimer, the term of this patent is extended or adjusted under 35 U.S.C. 154(b) by 586 days.

(21) Appl. No.: 11/088,295

(22) Filed: Mar. 24, 2005

(65) Prior Publication Data

US 2006/0081660 A1 Apr. 20, 2006

(30) Foreign Application Priority Data

Mar. 26, 2004 (GB) ..... 0406895.3

(51) Int. Cl.
*B22D 37/00* (2006.01)
*B65D 83/00* (2006.01)

(52) U.S. Cl. ..... 222/509; 222/505; 222/397; 222/511; 222/547; 222/564; 137/561 R; 137/212; 137/317; 251/149.3

(58) Field of Classification Search ..... 222/400.7, 222/505, 407, 400.8, 402.1, 380, 396, 397, 222/509, 511, 512, 547, 564; 137/317, 318, 137/319, 320, 321, 322, 212, 561 R, 206, 137/544, 587; 251/149.3, 350
See application file for complete search history.

(56) References Cited

U.S. PATENT DOCUMENTS 4,125,209 A * 11/1978 Bailey ..... 222/400.7
4,159,102 A * 6/1979 Fallon et al. ..... 251/149.6
4,503,999 A 3/1985 MacNair et al.
4,589,577 A * 5/1986 Welsh et al. ..... 222/518
4,756,347 A 7/1988 Hagan et al.
4,834,266 A * 5/1989 Brewer et al. ..... 222/147
5,062,548 A * 11/1991 Hedderick et al. ..... 222/190
5,863,577 A * 1/1999 Lynch et al. ..... 426/112
5,901,747 A * 5/1999 Rokkjaer ..... 137/614.2
5,947,343 A * 9/1999 Horstmann ..... 222/474
6,109,485 A * 8/2000 Amidzich ..... 222/400.7
6,454,243 B2 * 9/2002 Kawolics et al. ..... 251/262
6,474,504 B1 11/2002 Simmons et al.
2001/0025858 A1 10/2001 Davis et al.

FOREIGN PATENT DOCUMENTS

CA 1 213 565 11/1986
GB 2 362 873 A 12/2001

* cited by examiner

*Primary Examiner*—Kevin P Shaver
*Assistant Examiner*—Stephanie E Tyler
(74) *Attorney, Agent, or Firm*—Brooks Kushman P.C.

(57) ABSTRACT

A valve assembly including a main body (13,24) with a cavity (25) having an aperture (35*a*) formed through the main body and channels (26) formed radially in the cavity wall. A seal member (18) is shaped to fit within the cavity such that when the seal member moves away from the aperture flow is permitted in the channel toward and through the aperture. The valve is for incorporation with a tap device, particularly for use with a "mini-keg" of beverage.

16 Claims, 7 Drawing Sheets

VALVE AND TAP INCORPORATING SAME

BACKGROUND OF THE INVENTION

The present invention relates to a tap, but more particularly a valve in a tap for use in dispensing beverages, e.g. from a package.

Taps, often of a disposable nature made from plastic, are provided for dispensing wine from a bladder within a box and also for dispensing beer from a "mini-keg". Preferably such taps have an automatic closing action to avoid unintentional spillage or waste. The tap will have a resilient (e.g. spring-loaded) component to achieve this automatic closing.

A particular example of a mini-keg tap intended to provide at least some functionality comparable to an on-trade tap includes a body, push button activation means, a valve operated by the push button and a restrictor plate. The restrictor plate provides turbulence in the beverage desirable for serving the beverage with a suitable froth head. Apertures in the restrictor plate form the only path through which the beer can travel. In this prior art the restrictor plate is made of soft plastic and is not suitable for dispensing certain beverages, e.g. stout.

SUMMARY OF THE INVENTION

It is an object of the present invention to provide a tap and/or a valve assembly suitable for use with beverages that is an improvement or at least an alternative to existing designs.

In one broad aspect of the invention there is provided a tap assembly having a nozzle and a valve assembly including a main body with a cavity formed therein, there being an aperture formed from the cavity through a wall of the main body and a plurality of channels formed in the cavity wall extending radially from said aperture, the nozzle communicating with the aperture, further including a seal member with outward dimensions to fit within the cavity and against said aperture, the seal member having a substantially hemispherical outward contact surface and the cavity being concave to accommodate this hemispherical shape, such that when the seal member moves away from the aperture flow is permitted in the channel toward and through the aperture, and a restrictor plate including at least one aperture that aligns with at least one channel in the cavity.

In a second broad aspect of the invention there is provided a tap assembly, incorporating a valve assembly from the first aspect, further including a nozzle. In a preferred form the tap assembly also includes a pivoting lever, a front face, a restrictor plate and/or a straightening baffle within the nozzle.

It is possible that some of the features of the tap assembly described herein are separable from the valve assembly and thus amount to an independent invention not defined by the appended claims.

DETAILED DESCRIPTION

Figure 1:
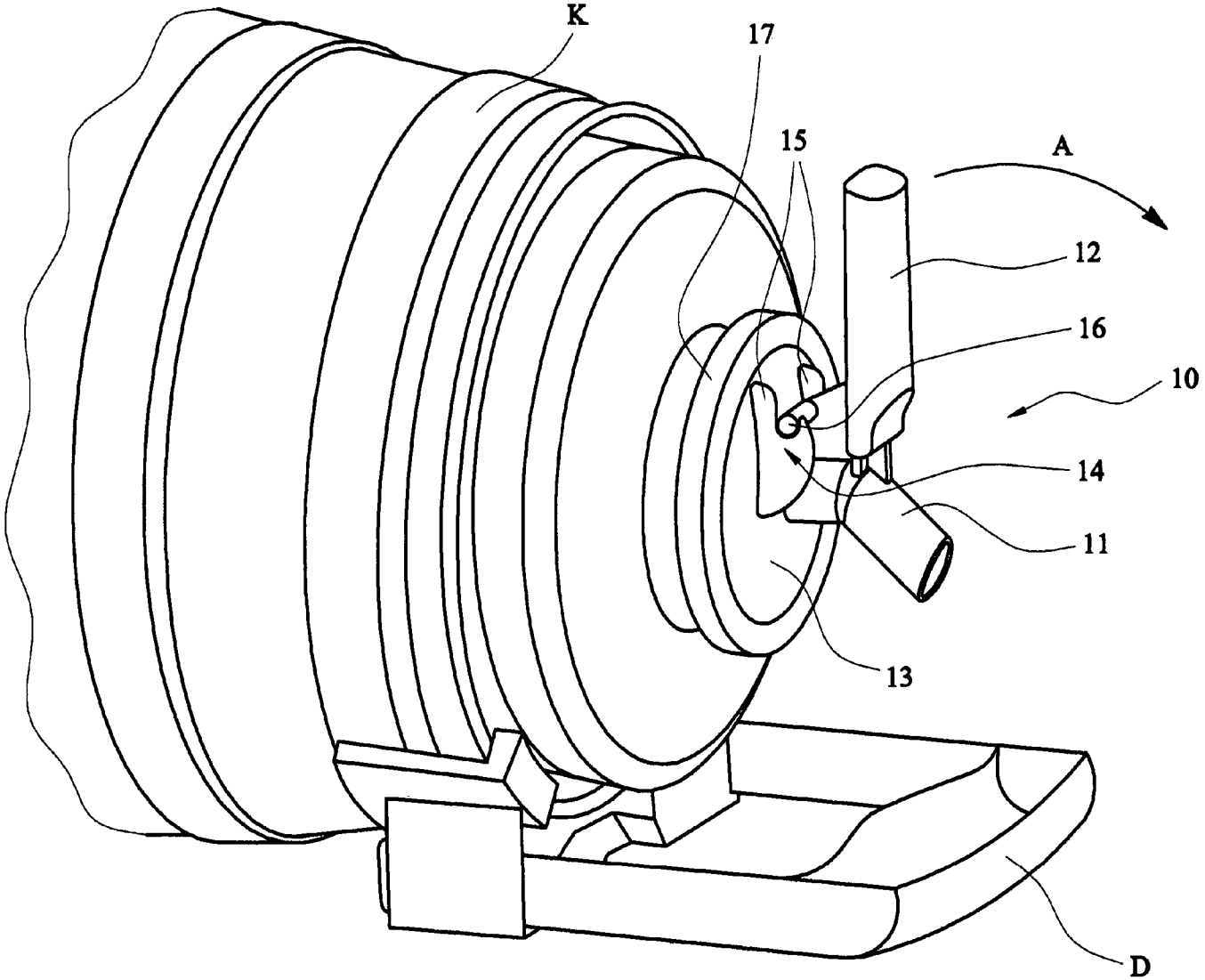
FIG. 1 is a pictorial view of an assembled tap installed on a mini-keg.

As shown in FIG. 1 a tap, generally denoted 10, according to the present invention is coupled to a keg K, over a clip-on drip tray D. Tap 10 externally includes a nozzle 11 and a lever handle 12 mounted to a front piece 13. It will be apparent that this nozzle/lever assembly is mounted in a cradle 14, formed by two extending flanges 15, by a cross bar 16 at the base of lever 12. Cross bar 16 provides a pivot axis for the lever 12 to be pulled in the direction of arrow A during use.

The tap assembly 10 would be swaged to the keg K at a peripheral circular edge 17. The method of coupling these components is known in the art and not a subject of the present invention.

Figure 2:
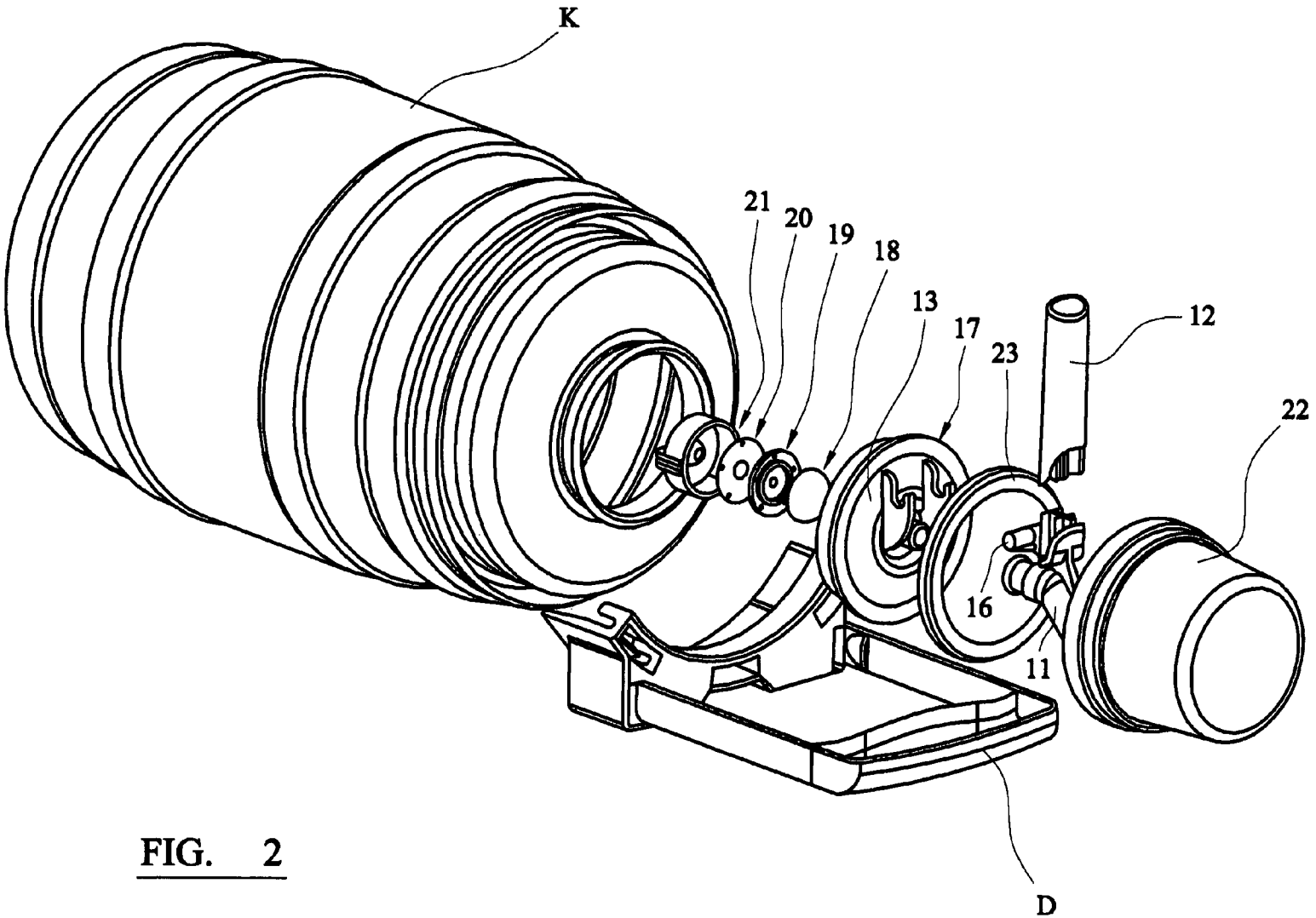
FIG. 2 is a front perspective view of a first embodiment showing components in exploded form.
Figure 3:
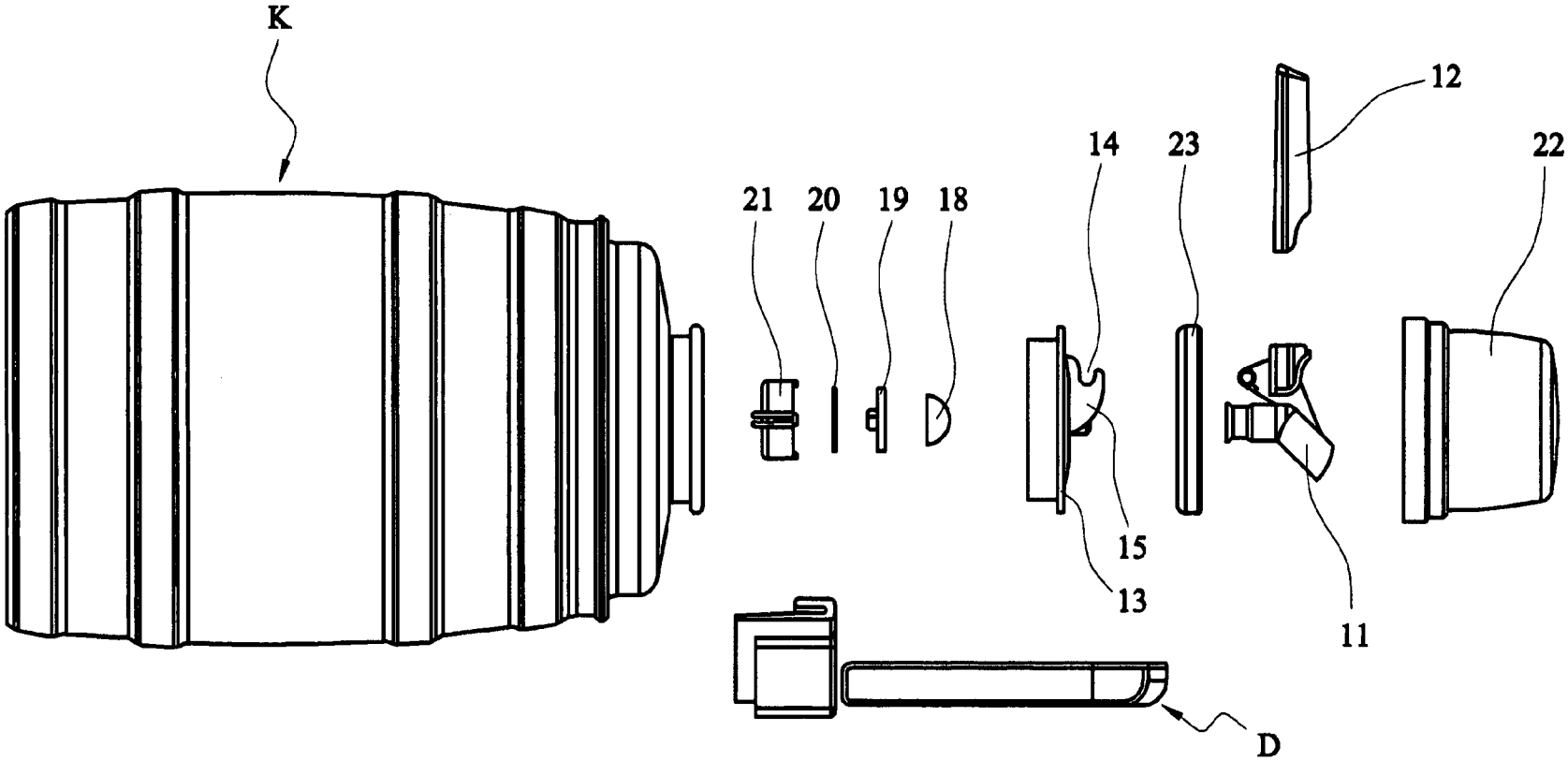
FIG. 3 is a side elevation view showing components in exploded form.
Figure 4:
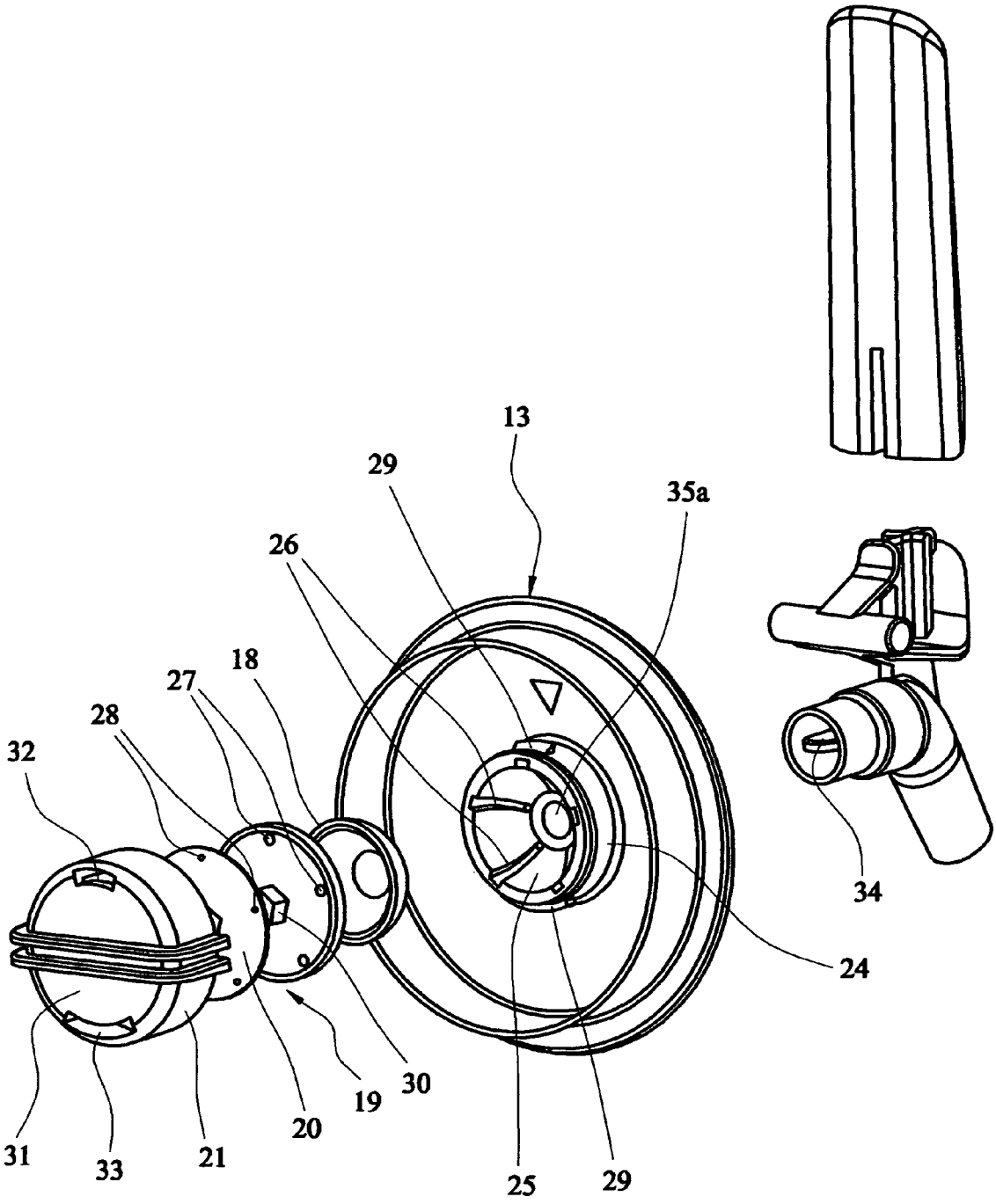
FIG. 4 is a rear perspective view.

The complete component parts of the tap 10 are best illustrated by FIGS. 2 to 4. Referring firstly to FIGS. 2 and 3 the internal parts of the tap are visible, namely hemispherical (the shape is hollow, therefore this component is more accurately a "hemispherical shell") valve seal 18, support plate 19, restrictor plate 20 and snap cover 21. An outer cap 22 is also shown that can snap over the entire tap 10 for storage purposes so long as the lever 12 (detachable in this view) is removed from its mounting adjacent nozzle 11.

A swaging ring 23 is provided to surround the peripheral edge of front piece 13 and be crimped to an opening of the keg K once tap 10 is assembled. Also, before sealing, the keg must be filled with beverage and, preferably, a pressure pouch inserted. Such a system for providing pressure internally in the keg is known, e.g. from U.S. Pat. No. 6,164,492. This pressurising method is not a subject of the present invention.

Operation of the tap is best described with reference to FIGS. 4 and 5. In FIG. 4 (viewed in a rearward direction) the main body or front piece 13 is seen to have a cylindrical protrusion 24 with a concave cavity 25 formed thereinto. The dimensions of this cavity fit the outward dimensions of hemispherical shaped seal 18. Cavity 25 further includes channels 26 of a shallow depth that curve to follow the concave shape of the cavity toward its centre. In the illustrated example of FIGS. 1 to 5 there are five such channels spaced radially and evenly apart to align at a peripheral edge of the cavity 25 with apertures 27/28 in both the support plate 19 and restrictor plate 20 respectively.

Alternative examples may have any number of channels, spaced radially or in some other effective configuration. Even a single channel could function to allow fluid flow through the valve in accordance with the invention. Furthermore, the shape of the cavity and/or the seal need not be limited to hemispherical. For example a conical shape may be employed.

The example of FIG. 4 illustrates the channels being tapered in depth and terminating substantially at or before the edge of an aperture 35*a* in the centre of the cavity 25, through which the seal is accessed to be deformed as hereinafter described. However, by virtue of the tapered depth, seal 18 is effectively closed against the edge of aperture 35*a* in normal assembly (until deformed/opened). Tapering is not essential so long as a seal can form to prevent fluid flow through aperture 35*a*. Minor adjustments to the assembly will be apparent to those skilled in the art.

The seal 18, support plate 19 and restrictor plate 20 are sandwiched together by closing the snap cover 21 over protrusion (main body) 24. This "snaps" in place by virtue of a conventional snap fit arrangement (tab protrusions 29 into channels/grooves/apertures on an internal wall within cover 21). FIG. 5 shows the assembled restrictor/valve construction in cross section form.

When assembled, a pentagon shaped protrusion 30 from the centre of support plate 19 holds restrictor plate 20 such that apertures 27 and 28 at the edges are aligned. Pentagon 30 further fits with a like-shaped aperture 31 in the back wall of snap-cover 21. The pentagon shape is not mandatory. Protrusion 30/aperture 31 could be any shape (non-cylindrical) that prevents rotational movement of the plate assemblies.

Figure 5A:
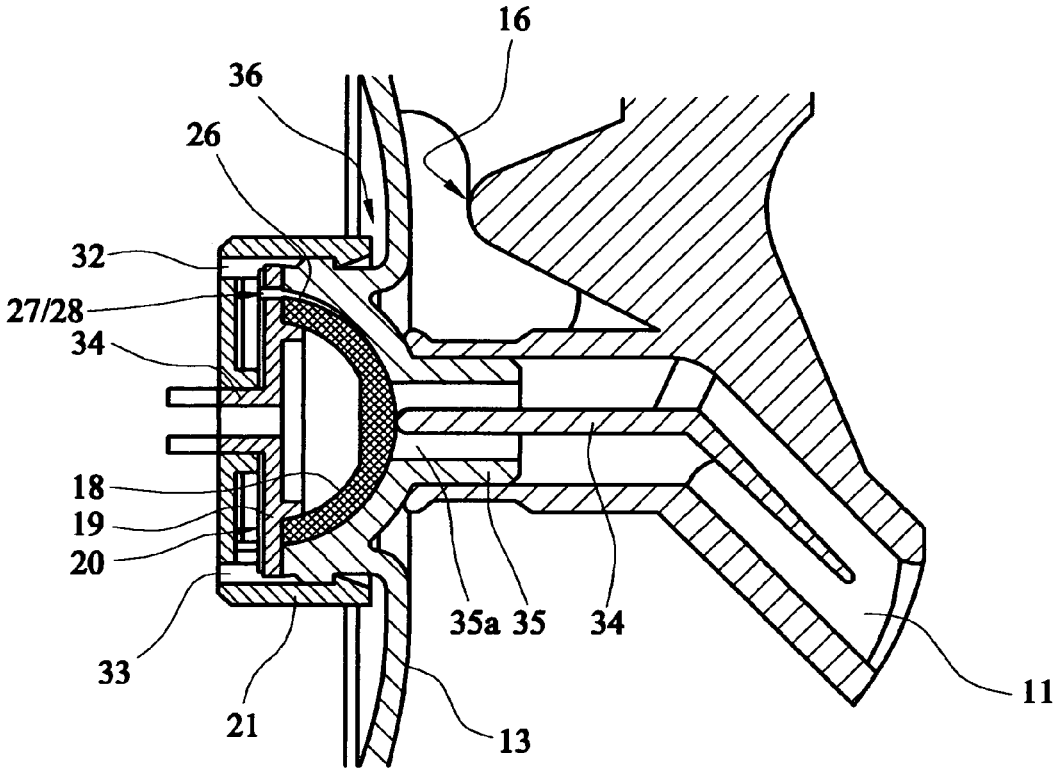
FIGS. 5*a* and 5*b* are side and plan section views respectively of the tap's valve.
Figure 5B:
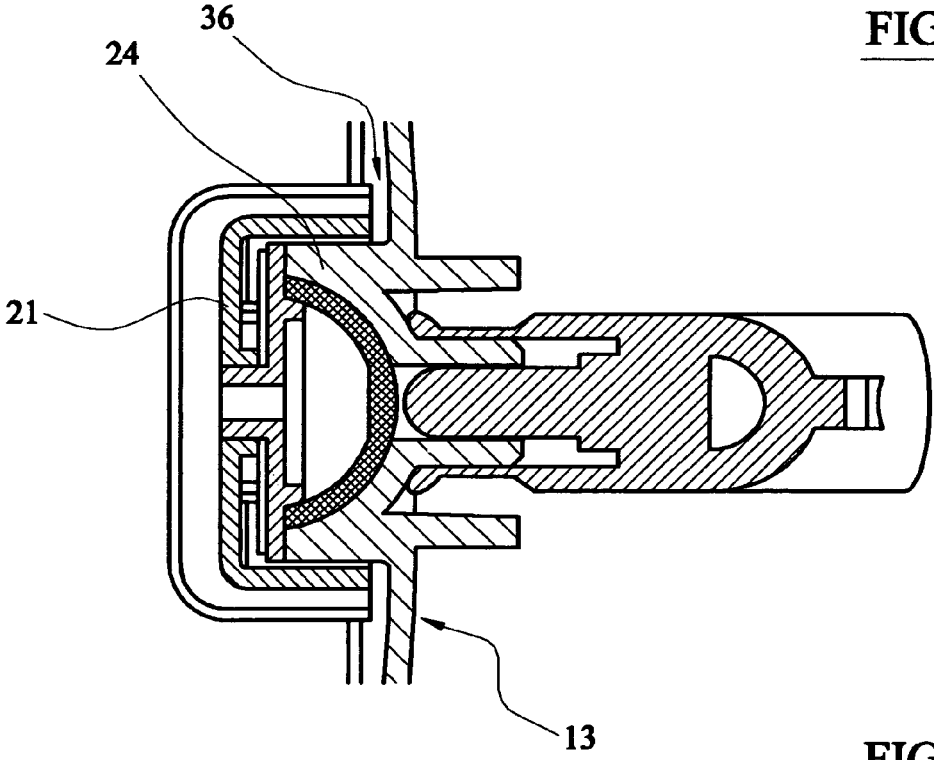
Figure 7:
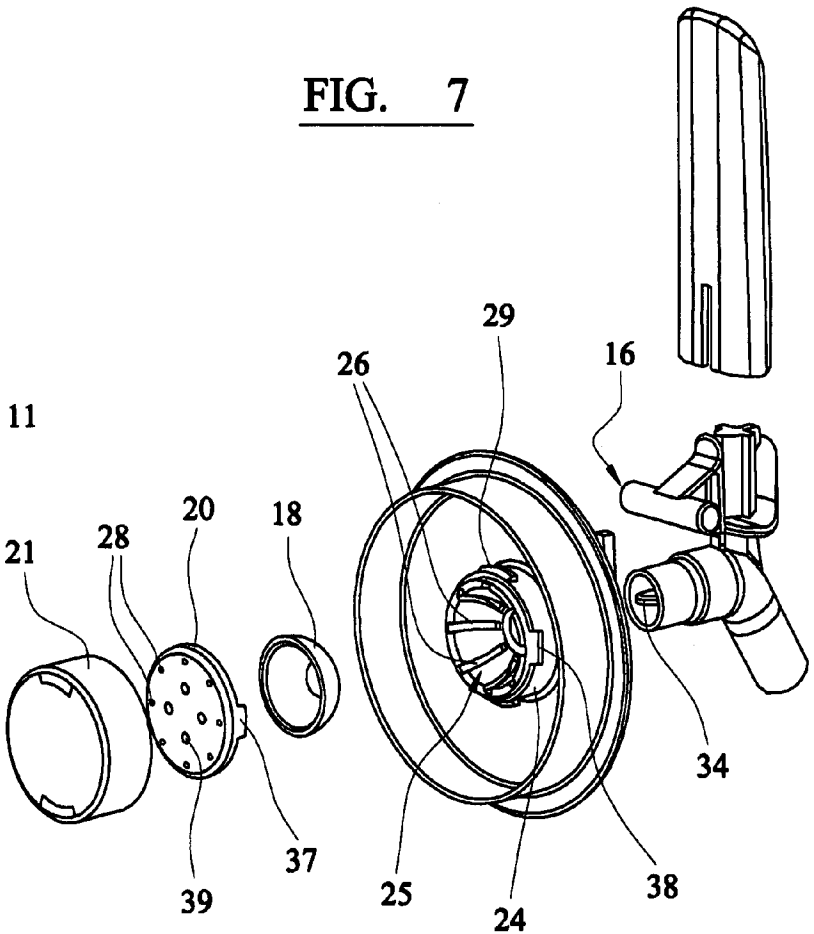
FIG. 7 is a rear perspective of the tap assembly from FIG. 6, FIGS. 8*a* and 8*b* are plan and side section views respectively of the second embodiment tap/valve.
Figure 6:
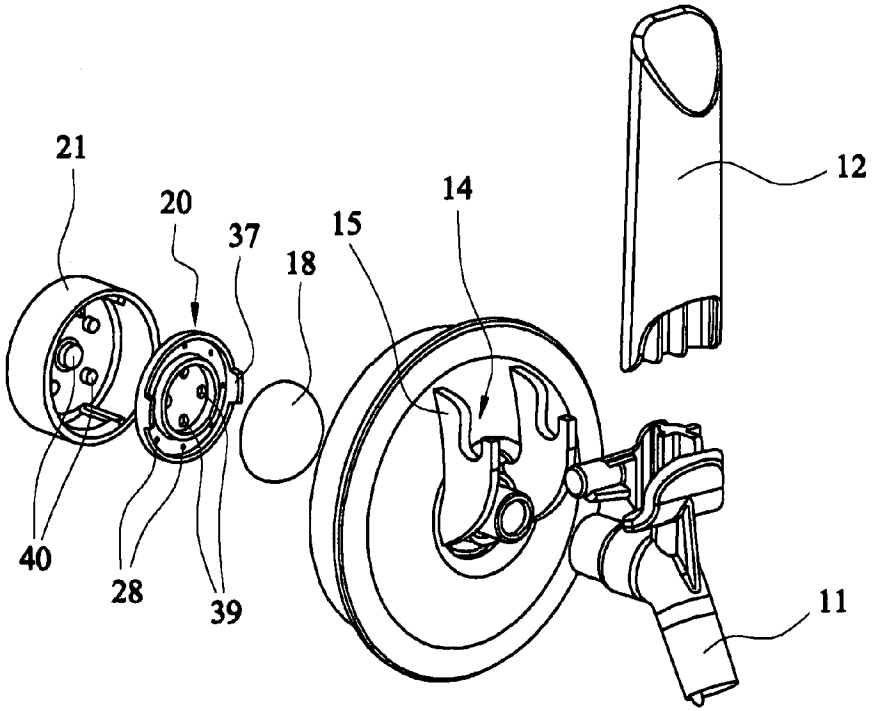
FIG. 6 is a front perspective view of a second embodiment.

Liquid flow is allowed through snap cover 21 via an upper 32 and lower 33 aperture, but more particularly through a gap 36 (not seen in FIG. 4) formed between the snap cover 21 and cylindrical (main body) protrusion 24 at the forward end of the valve (see FIG. 5*b*). Flow can then be directed only through the five aligned apertures 27/28. Overall the fluid flow bends in an "s" or "z" shape when following gap 36.

Both FIGS. 5*a* and 5*b* show the valve assembly in a closed position (being side and plan elevation views respectively). However, it will be apparent that a (tapered) channel 26 will become "open" when hemispherical seal 18 is deformed inwards, hence allowing flow past the valve and into nozzle 11. This flow is agitated by the apertures 27(28) but then straightened by a baffle 34 within nozzle 11.

Only one channel 26 is visible in FIG. 5*a*, due to the spacing of the five channels. The remaining four are hidden in this cross section view. No channels are visible in FIG. 5*b*.

In the preferred form of the invention the materials of the components affect functionality. It will be expected that valve seal 18 be formed from a resilient rubbery material that will return to its original cast shape once frontal pressure is removed. In order for the valve seal to be suitably deformed for opening it is necessary (in the embodiment of FIGS. 1 to 5) that front piece 13 also has a resilient nature (e.g. moulded from a thermoplastic elastomer) or at least includes a component (e.g. in the area surrounding sleeve 35) that is resilient. In this way pulling lever 12 will cause deformation of (at least part of) front piece 13 as well as seal 18. Specifically, it will be noted that the rear of nozzle 11 has an interference fit with a sleeve 35 protruding from front piece 13 and baffle 34 extends through aperture 35*a* to be substantially in contact with the outward surface of seal 18 (see FIG. 5*a*). Pivot 16 provides the focused thrust on seal 18 that opens flow.

The intended method of pressurisation within the keg K is by use of a pressure pouch known in the art (not illustrated) Snap cover 21 prevents the pressure pouch from pushing up against the restrictor and blocking the apertures 27. The pouch is activated by applying a pressure back through the tap. When gas is fed back through the tap the restrictor plate and support plate float away from the valve allowing the gas to enter more quickly. When the pouch has been activated, the pressure inside the keg increases pushing the plates back up against the valve, ensuring liquid has to pass through the restrictor to exit the keg.

As stated previously the pressurisation aspect of the keg is not part of the present invention. It is possible that the assembly design could be modified to eliminate "gas fed back through the tap" without departing from the scope of the present invention. An embodiment for use with a system wherein "back gassing" is no longer required is described with reference to FIGS. 6 to 9.

It will be apparent that, by virtue of the resilient components, the tap has an automatic close function when the lever 12 is released from its movement in the direction of arrow A.

It will also be apparent that several modifications could be made that still fall within the scope of the invention. For example dimensions and positioning of the restrictor/support plate could be varied depending on the beverage (or omitted completely—note that the restrictor plate is best suited for use with stout beer). An alternative arrangement may include a push button activation in place of the lever, e.g. a resilient button mounted coaxially with the seal, using a "pin" to press in the seal 18 (this "pin" taking a form similar in appearance to the baffle 34 shown by FIG. 5*a*).

Yet a further alternative could feature a more rigid seal 18 with an integral "pin" through aperture 35*a* such that a resilient action performed by some other component (e.g. a push button) keeps the seal 18 against cavity 25, closing channels 26, until the pin presses seal 18 away from aperture 35*a*. No actual deformation of seal (formed in a hemispherical shape or otherwise) is necessary in this alternative.

FIGS. 6 to 9 illustrate an alternative embodiment. Equivalent reference numerals have been used where possible, as components for this second embodiment are similar to those of the first embodiment. The main difference is that the restrictor plate 20 does not require a support plate (19). The apertures 28 of this assembly are aligned with the (eight) channels 26 of the cavity 25 by virtue of a simple tab 37 protruding from opposite sides of the plate 20 and fitting into corresponding grooves 38 formed in the cylindrical protrusion or main body 24.

In the first embodiment the central aperture 31 and ridge in the snap cover 21 was necessary to give a path for liquid to the back of the rubber valve to hold it closed. In the second embodiment the restrictor plate 20 does not move to allow "back gassing" of the system so apertures 39 are provided to perform this function.

Protrusions 40 in the inside back wall of snap cover 21 provide a spacing function for the restrictor plate 20 to permit flow through the apertures 28.

Figure 9:
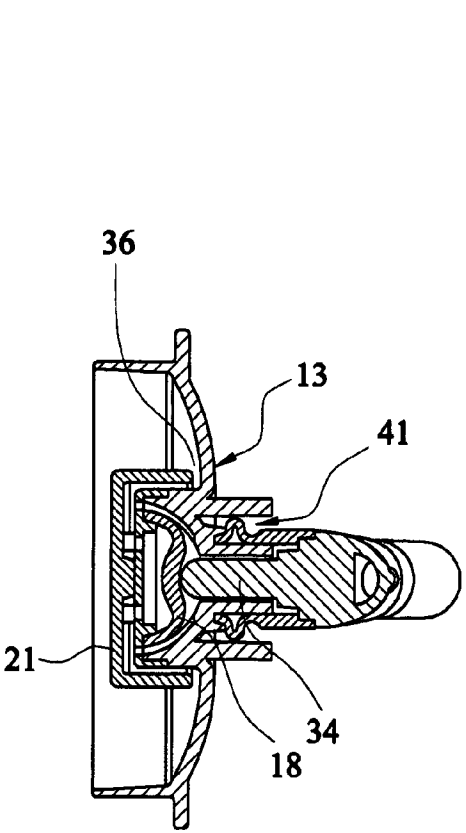
FIG. 9 is a section plan view of the valve in "open" position.
Figure 8B:
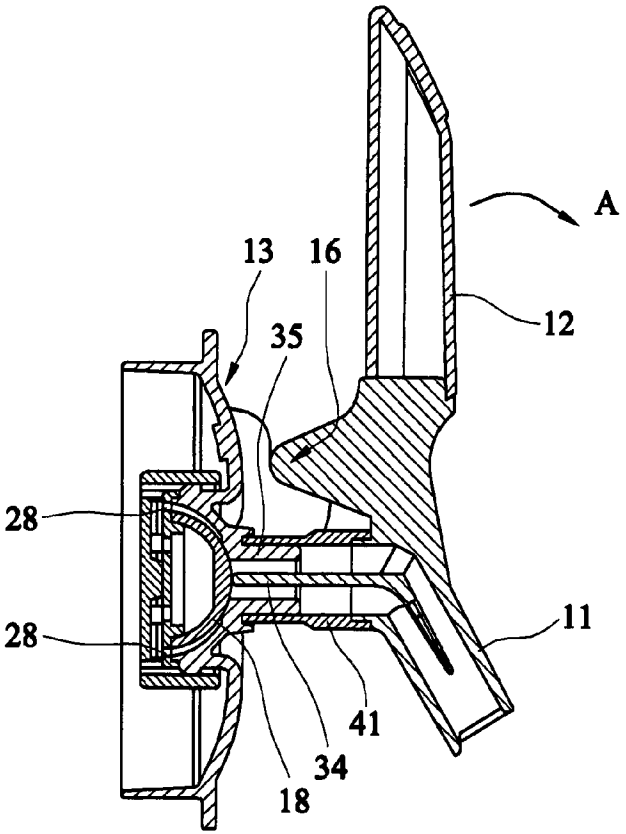
Figure 8A:
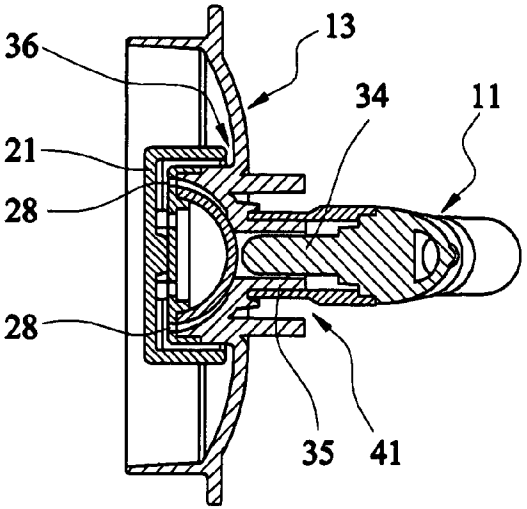

As best seen by FIGS. 8 and 9, the front piece 13 is formed of a substantially rigid material and sleeve 35 is coupled to nozzle section 11 by a resilient over sleeve 41 (shown with a thin wall in part of the cross section for enhancing flexibility) in an interference (or adhered) fit. In this way, pulling lever 12 to pivot the nozzle section 11 about pivot 16 in cradle 14 will thrust baffle 34 against seal 18 causing deformation (see FIG. 9) and open flow through the valve.

The liquid flow path is otherwise substantially the same as the first embodiment, i.e. from the keg into gap 36 and around the cylindrical protrusion 24 to fill a gap at the rear inside wall of the snap cover 21 and then through apertures 28 in the restrictor 20 that cause agitation in the liquid. Liquid exits past the valve 18 in channels 26 and out through nozzle 11 while being "straightened" by baffle 34.

The novel construction of the valve (including z shaped flow path) enables the tap to be used effectively with kegs that have a pressure pouch type pressurisation system.

Modifications are possible to the general construction that remain with the intended scope of the invention defined by the claims. Components should be given a broad interpretation as to purpose. For example, the cavity 25 could be in the form of a flat piece (or very shallow curvature) with radiating channels from the centre. In this alternative, valve 18 would be a substantially flat disc and rely on its resilience and internal pressure to maintain a seal. It is expected that such embodiments may not work as effectively as the main embodiments described, however, they are mentioned for the sake of completeness.

What is claimed is:

1. A tap assembly having a nozzle and a valve assembly including a main body with a cavity formed therein, there being an aperture formed from the cavity through a wall of the main body and a plurality of channels formed in the cavity wall extending radially from said aperture, the nozzle communicating with the aperture, further including a seal member with outward dimensions to fit within the cavity and against said aperture, the seal member having a substantially hemispherical outward contact surface and the cavity being concave to accommodate this hemispherical shape, such that when the seal member moves away from the aperture flow is permitted in the channels toward and through the aperture, and a restrictor plate including at least one aperture that aligns with at least one channel in the cavity.

2. The tap assembly of claim 1 wherein said plurality of channels extend radially from the aperture to an edge of the cavity.

3. The tap assembly of claim 1 wherein the depth of each channel is tapered toward and terminates at or before the aperture.

4. The tap assembly of claim 1 wherein the seal member is resiliently deformable.

5. A tap assembly incorporating a valve assembly according to claim 1, wherein the restrictor plate includes a plurality of apertures respectively aligned with a plurality of the channels in the cavity.

6. The tap assembly of claim 5 further including a support plate including a plurality of apertures respectively aligned with the plurality of apertures in the restrictor plate and the plurality of channels in the cavity.

7. The tap assembly of claim 1 further including a support plate with at least one aperture to align with said at least one restrictor plate aperture.

8. The tap assembly of claim 1 further including a cover that encloses and sandwiches together the restrictor plate and seal member to the cavity by a connector with the main body.

9. The tap assembly of claim 8 wherein the cover includes an aperture or gap between it and the main body, to permit fluid flow communicating with the apertures in the restrictor plate.

10. The tap assembly of claim 1 further including an alignment means that maintains said at least one aperture of the restrictor plate in alignment with said at least one channel in the cavity.

11. The tap assembly of claim 1 further including an actuated member adapted to travel through the aperture in the cavity and move the seal member.

12. The tap assembly of claim 11 further including a pivotally mounted lever that moves the actuated member.

13. The tap assembly of claim 1 further including a front piece coupled or integral with the main body and from which the nozzle extends, said front piece being formed at least in part of a resilient material such that deformation of the front piece causes movement of the seal member away from the aperture, thereby opening flow in the channels.

14. The tap assembly of claim 13 further including a pivotal lever on the front piece which is deformed by the pivotal lever.

15. The tap assembly of claim 1 further including a resilient sleeve that couples the main body to the nozzle.

16. The tap assembly of claim 1 wherein the nozzle includes a flow-straightening baffle.

* * * * *